US011485916B2

(12) United States Patent
Marques et al.

(10) Patent No.: US 11,485,916 B2
(45) Date of Patent: Nov. 1, 2022

(54) METHOD FOR CONVERTING RESIDUES INCORPORATING DEEP HYDROCONVERSION STEPS AND A DEASPHALTING STEP

(71) Applicant: IFP Energies Nouvelles, Rueil-Malmaison (FR)

(72) Inventors: Joao Marques, Chasse sur Rhone (FR); Matthieu Dreillard, Lyons (FR); Frederic Feugnet, Lyons (FR); Jean-Francois Le Coz, Saint Germain en Laye (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 0 days.

(21) Appl. No.: 16/956,098

(22) PCT Filed: Dec. 7, 2018

(86) PCT No.: PCT/EP2018/084053
§ 371 (c)(1),
(2) Date: Jun. 19, 2020

(87) PCT Pub. No.: WO2019/121074
PCT Pub. Date: Jun. 27, 2019

(65) Prior Publication Data

US 2021/0102130 A1 Apr. 8, 2021

(30) Foreign Application Priority Data

Dec. 21, 2017 (FR) ..... 1762866

(51) Int. Cl.

| | |
|---|---|
| ***C10G 11/04*** | (2006.01) |
| ***C10G 11/05*** | (2006.01) |
| ***C10G 11/18*** | (2006.01) |
| ***C10G 69/04*** | (2006.01) |
| ***C10G 47/30*** | (2006.01) |
| ***C10G 67/04*** | (2006.01) |
| ***C10G 47/02*** | (2006.01) |

(52) U.S. Cl.
CPC ..... *C10G 67/049* (2013.01); *C10G 47/02* (2013.01); *C10G 47/30* (2013.01); *C10G 67/0463* (2013.01); *C10G 69/04* (2013.01); *C10G 2300/206* (2013.01); *C10G 2300/4006* (2013.01); *C10G 2300/4012* (2013.01); *C10G 2300/4018* (2013.01)

(58) Field of Classification Search
CPC ..... C10G 11/04; C10G 11/05; C10G 11/18; C10G 47/30; C10G 67/049; C10G 67/0463; C10G 69/04; C10G 2300/4006; C10G 2300/4012; C10G 2300/4018
See application file for complete search history.

(56) References Cited

U.S. PATENT DOCUMENTS

| | | | | |
|---|---|---|---|---|
| 9,650,580 | B2 | 5/2017 | Merdrignac et al. | |
| 10,501,695 | B2 * | 12/2019 | Morel | C10G 65/12 |
| 2013/0112595 | A1 | 5/2013 | Al-Abdulal et al. | |
| 2016/0312130 | A1 | 10/2016 | Merdrignac et al. | |
| 2018/0195013 | A1 | 7/2018 | Dreillard et al. | |

FOREIGN PATENT DOCUMENTS

| | | | | |
|---|---|---|---|---|
| FR | 2999599 | A1 | 6/2014 | |
| FR | 3030568 | A1 | 6/2016 | |
| FR | 3033797 | A1 | 9/2016 | |
| WO | 10033487 | A2 | 3/2010 | |
| WO | WO-2010033487 | A2 * | 3/2010 | C10G 65/10 |

OTHER PUBLICATIONS

International Search report PCT/EP2018/084053 dated Feb. 13, 2019 (pp. 1-3).

* cited by examiner

*Primary Examiner* — Randy Boyer
(74) *Attorney, Agent, or Firm* — Millen, White, Zelano & Branigan, P.C.; Harry B. Shubin

(57) ABSTRACT

The invention concerns a method for converting heavy hydrocarbon feedstocks of which at least 50% by weight boils at a temperature of at least 300° C., and in particular vacuum residues. The feedstocks are subjected to a first step a) of deep hydroconversion, optionally followed by a step b) of separating a light fraction, and a heavy residual fraction is obtained from step b) of which at least 80% by weight has a boiling temperature of at least 250° C. Said fraction from step b) or the effluent from step a) is then subjected to a second step c) of deep hydroconversion. The overall hourly space velocity for steps a) to c) is less than 0.1 $h^{-1}$. The effluent from step c) is fractionated to separate a light fraction. The heavy fraction obtained, of which 80% by weight boils at a temperature of at least 300° C., is sent to a deasphalting step e). The deasphalted fraction DAO is then preferably converted in a step f) chosen from ebullated bed hydroconversion, fluidised bed catalytic cracking and fixed bed hydrocracking.

8 Claims, 1 Drawing Sheet

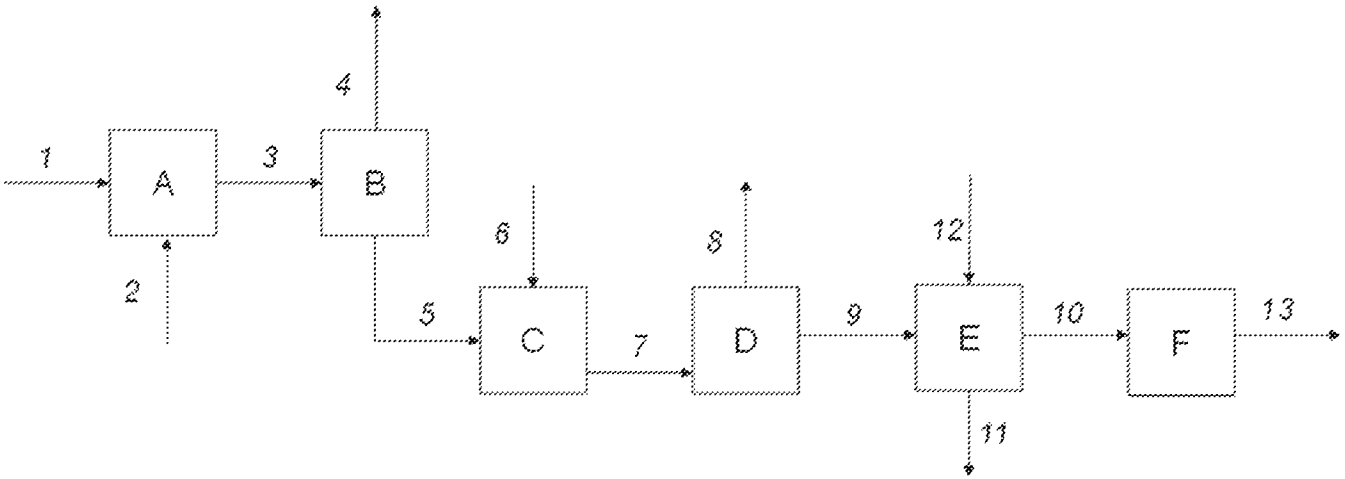
1
A
2
3
B
4
5
C
6
7
D
8
9
E
12
11
10
F
13

METHOD FOR CONVERTING RESIDUES INCORPORATING DEEP HYDROCONVERSION STEPS AND A DEASPHALTING STEP

The present invention relates to the conversion of heavy hydrocarbon feedstocks including at least 50% by weight of a fraction having a boiling point of at least 300° C. These are crude oil or feedstocks resulting, directly or after treatment, from the atmospheric and/or vacuum distillation of a crude oil, such as atmospheric or vacuum residues.

It is relatively difficult to enhance these oil residues in value, both from a technical viewpoint and from an economic viewpoint. This is because new regulatory constraints are drastically lowering the maximum admissible content of sulfur in bunker fuel oils (from 3% by weight to 0.5% by weight of sulfur). In addition, the market is in particular demanding fuels which can be distilled at atmospheric pressure at a temperature of less than 380° C., indeed even less than 320° C.

PRIOR ART

Patent FR 2 906 814 of the Applicant Company describes a process comprising successively linking together a deasphalting stage, producing a deasphalted oil, a stage of hydroconversion of said deasphalted oil, to produce an effluent, and a stage of distillation of said effluent, to produce a residue which is returned, with the feedstock, to the deasphalting stage. This patent describes a sequence of processes in which the hydroconversion stage is carried out at conventional space velocities (HSVs) of 0.1 $h^{-1}$ to 5 $h^{-1}$ and the SDA stage is carried out upstream of the hydroconversion stage. The large amount of asphalt produced limits the maximum level of overall conversion of the process.

Patent FR 2 964 386 of the Applicant Company describes the sequence of a process for the treatment of feedstocks resulting from crude oil or from atmospheric or vacuum distillation of crude oil. The process comprises a stage of ebullating-bed hydroconversion (referred to as H-Oil® or LC-Fining process), followed by a stage of separation of a light fraction (boiling point of less than 300° C., preferably of less than 375° C.), and the resulting heavy fraction is directly subjected to a deasphalting stage, to produce a deasphalted oil (DAO). The DAO can be hydrocracked or hydrotreated or also fractionated.

The ebullating-bed hydroconversion stage is carried out at space velocities (HSVs) of 0.1 $h^{-1}$ to 10 $h^{-1}$. The example of the patent is carried out at HSV=0.3 $h^{-1}$ and at a conversion (with respect to the 540° C.+ residue, i.e. the residue boiling at 540° C. or more) in the vicinity of 60% by weight with regard to the ebullating bed part.

This simple and economical process makes possible thermal integration within one and the same reaction section and makes it possible to obtain a DAO of good quality; nevertheless, the asphalt yields are high, which limits the maximum overall conversion achievable by this process.

It is also known (U.S. Pat. No. 7,938,952) to operate with two ebullating-bed hydroconversion stages at overall space velocities of at least 0.1 $h^{-1}$ (referred to as H-Oil® process) with an intermediate separation, in order to separate the light fraction, and passage of the resulting heavy fraction into the second hydroconversion stage, and then the effluent resulting from the second hydroconversion is directly distilled. "Overall space velocities" is understood to mean the flow rate of the hydrocarbon feedstock, taken under standard temperature and pressure conditions, divided by the combined volumes of the reactors constituting the hydroconversion stages.

Patent FR 3 033 797 of the Applicant Company describes a process for the treatment of feedstocks resulting from crude oil or from atmospheric or vacuum distillation of crude oil, at least 80% by weight of which exhibits a boiling point of at least 300° C. The process comprises a hydroconversion stage (first hydroconversion), followed by a separation of the light fraction (boiling point of less than 350° C.), and the resulting heavy fraction is subjected to a hydroconversion (second hydroconversion) separated from the first; the effluent obtained is subsequently fractionated by distillation. This hydroconversion process is operated at a low overall HSV, preferably of 0.05 $h^{-1}$ to 0.09 $h^{-1}$.

The advantage contributed by the low overall HSV is a high purification, which makes it possible to obtain a residue with a low content of asphaltenes and Conradson carbon, for a high level of conversion of the residue (>75%). The stability of the liquid effluents is improved. The content of sediments at the hydroconversion outlet is reduced, which brings about better operability of the process. The overall conversion of this process is limited by the unconverted heavy effluent.

SUMMARY OF THE INVENTION

A process has now been sought which has improved performance qualities, in particular with a high conversion of fuels (naphtha, kerosene, gas oil), in order to fit the market.

It was possible to modify the process of the most recent art (FR 3 033 797) to increase the conversion of the deep hydroconversion stages while lowering even further the overall HSV.

The Applicant Company has demonstrated that a better solution is to add a deasphalting stage to the process of the most recent prior art, which makes it possible to obtain a high level of the yield and of quality of the DAO, and to treat the DAO in at least one conversion stage, the latter preferably being carried out at high HSV, and to thus increase the conversion while contributing a markedly improved operability and a substantial saving with regard to the capital invested and a better in return on the investment. The present invention also makes it possible to further reduce the resulting amount of asphalt, in comparison with the processes having a greater overall HSV.

More specifically, the invention relates to a process for the conversion of hydrocarbon feedstocks, at least 50% by weight, preferably at least 80% by weight, of which boils at a temperature of at least 300° C., comprising the following successive stages:

in a stage a), a first deep hydroconversion of said hydrocarbon feedstock is carried out in the presence of hydrogen, under an absolute pressure of between 2 MPa and 35 MPa, at a temperature of between 300° C. and 550° C., with an amount of hydrogen of between 50 $Sm^3/m^3$ and 5000 $Sm^3/m^3$, with a catalyst containing at least one metal from Group VIII chosen from nickel and cobalt and at least one metal from Group VIb chosen from molybdenum and tungsten, —optionally a stage b) of separation of a light fraction from a part or all of the effluent resulting from said first hydroconversion, and at least one heavy fraction, at least 80% by weight of which exhibits a boiling point of at least 250° C., is obtained, in a stage c), a second deep hydroconversion of a part or all of the liquid effluent resulting from stage a) or the heavy fraction resulting from stage b) is carried out in the presence of hydrogen, under an absolute pressure of between 2 MPa and 35 MPa, at a temperature of between 300° C. and 550° C., with an amount of hydrogen of between 50 $Sm^3/m^3$ and 5000 $Sm^3/m^3$, with a catalyst containing at least one metal from Group VIII chosen from nickel and cobalt and at least one metal from Group VIb chosen from molybdenum and tungsten, and the overall hourly space velocity for stages a) to c) is less than 0.1 $h^{-1}$, the overall velocity being the flow rate of liquid feedstock of the hydroconversion stage a), taken under standard temperature and pressure conditions, with respect to the total volume of the reactors of stages a) and c), a stage d) of separation of a part or all of the effluent resulting from said second hydroconversion into at least one light fraction and at least one heavy fraction, at least 80% by weight of which exhibits a boiling point of at least 300° C., a stage e) of deasphalting said heavy fraction resulting from stage d), at a temperature of between 60° C. and 250° C., with at least one hydrocarbon solvent having from 3 to 7 carbon atoms, and a solvent/feedstock ratio (volume/volume) of between 4/1 and 9/1, and a deasphalted fraction DAO and an asphalt are obtained.

Advantageously, the process comprises a stage f) of conversion of a part or all of said, optionally distilled, deasphalted fraction DAO.

Preferably, the DAO is distilled before the conversion stage f), so as to separate a heavy fraction, at least 80% by weight of which exhibits a boiling point of at least 375° C., or of at least 400° C., or of at least 450° C., or of at least 500° C., and preferably of at least 540° C., and said heavy fraction sent, in part or in its entirety, into the conversion stage f).

Preferably, a part or all of the DAO fraction is sent, preferably directly, into a conversion stage operating with a process chosen from the group formed by fixed-bed hydrocracking, fluidized-bed catalytic cracking and ebullating-bed hydroconversion, it being possible for these processes to comprise a preliminary hydrotreating.

According to a preferred embodiment, a part or all of the deasphalted fraction DAO is subjected to a fixed-bed hydrocracking, in the presence of hydrogen, under an absolute pressure of between 5 MPa and 35 MPa, at a temperature of advantageously between 300° C. and 500° C., an HSV of between 0.1 $h^{-1}$ and 5 $h^{-1}$ and an amount of hydrogen of between 100 $Sm^3/m^3$ and 1000 $Sm^3/m^3$ (standard cubic meters ($Sm^3$) per cubic meter ($m^3$) of liquid feedstock), and in the presence of a catalyst containing at least one non-noble element from Group VIII and at least one element from Group VIb and comprising a support containing at least one zeolite.

According to another preferred form, a part or all of the deasphalted fraction DAO is subjected to a fluidized-bed catalytic cracking FCC in the presence of a catalyst, preferably devoid of metals, comprising alumina, silica, silica/alumina, and preferably comprising at least one zeolite.

According to another preferred form, a part or all of the deasphalted fraction DAO is subjected to an ebullating-bed hydroconversion, carried out in the presence of hydrogen, under an absolute pressure of between 2 MPa and 35 MPa, at a temperature of between 300° C. and 550° C., an amount of hydrogen of between 50 $Sm^3/m^3$ and 5000 $Sm^3/m^3$ (standard cubic meters ($Sm^3$) per cubic meter ($m^3$) of liquid feedstock), an HSV of between 0.1 $h^{-1}$ and 10 $h^{-1}$ and in the presence of a catalyst containing a support and at least one metal from Group VIII chosen from nickel and cobalt and at least one metal from Group VIb chosen from molybdenum and tungsten.

It is possible for at least a part of said deasphalted fraction DAO to be recycled to stage a) and/or to stage c).

Advantageously, in the separation stage d), the effluent resulting from said second hydroconversion is separated into at least one light fraction and at least one heavy fraction, at least 80% by weight of which exhibits a boiling point of at least 375° C., or of at least 400° C., or of at least 450° C., or of at least 500° C., and preferably of at least 540° C.

Generally, stages a) and c) are carried out under an absolute pressure of between 5 MPa and 25 MPa and preferably between 6 MPa and 20 MPa, at a temperature of between 350° C. and 500° C. and preferably of between 370° C. and 430° C. and more preferably of between 380° C. and 430° C., with an amount of hydrogen of between 100 $Sm^3/m^3$ and 2000 $Sm^3/m^3$ and very preferably between 200 $Sm^3/m^3$ and 1000 $Sm^3/m^3$, the hourly space velocity (HSV) being at least 0.05 $h^{-1}$, preferably between 0.05 $h^{-1}$ and 0.09 $h^{-1}$.

Generally, stage e) is carried out with a solvent chosen from the group formed by butane, pentane and hexane, and their mixtures.

DETAILED DESCRIPTION OF THE INVENTION

The Fillers

The fillers which are treated in the context of the present invention are those, at least 50% by weight, preferably at least 80% by weight, of which exhibits a boiling point of at least 300° C. (T20=300° C.), preferably of at least 350° C. or of at least 375° C.

These are crude oils or heavy hydrocarbon fractions resulting from the atmospheric and/or vacuum distillation of a crude oil. These can also be atmospheric residues and/or vacuum residues, and in particular atmospheric and/or vacuum residues resulting from hydrotreating, hydrocracking and/or hydroconversion. These can also be vacuum distillates, cuts originating from a catalytic cracking unit, such as FCC (fluidized-bed catalytic cracking), from a coking unit or from a visbreaking unit.

Preferably, these are vacuum residues. Generally, these residues are fractions, at least 80% by weight of which boils at a boiling point of at least 450° C. or more, and most often of at least 500° C. or 540° C.

Aromatic cuts extracted from a unit for the production of lubricants, deasphalted oils (raffinates resulting from a deasphalting unit) or asphalts (residues resulting from a deasphalting unit) may also be suitable as feedstocks.

The feedstock can also be a residual fraction resulting from the direct liquefaction of coal (an atmospheric residue and/or a vacuum residue resulting, for example, from the H-Coal® process), a vacuum distillate resulting from the direct liquefaction of coal (for example, from the H-Coal® process), residues from the pyrolysis of coal or shale oils, or else a residual fraction resulting from the direct liquefaction of lignocellulosic biomass, alone or as a mixture with coal and/or a petroleum fraction.

All these feedstocks can be used alone or as a mixture.

The abovementioned feedstocks contain impurities, such as metals, sulfur, nitrogen, Conradson carbon and heptane insolubles, also known as $C_7$ asphaltenes. The contents of metals are generally greater than 20 ppm by weight, most often greater than 100 ppm by weight. The sulfur content is greater than 0.1% by weight, often greater than 1% by weight or than 2% by weight. The content of $C_7$ asphaltenes (heptane-insoluble asphaltenes according to the standard NFT60-115) amounts to a minimum of 0.1% by weight and is often greater than 3% by weight. The content of Conradson carbon is at least 3% by weight, often at least 5% by weight. The content of Conradson carbon is defined by the standard ASTM D 482 and represents, for a person skilled in the art, a well-known evaluation of the amount of carbon residue produced after a pyrolysis under standard temperature and pressure conditions. These contents are expressed in % by weight, with respect to the total weight of the feedstock.

The First Deep Hydroconversion Stage (Stage a))

The feedstock is treated in a hydroconversion stage a) comprising at least one or more three-phase reactors arranged in series and/or in parallel. These hydroconversion reactors can, inter alia, be reactors of fixed-bed, moving-bed, ebullating-bed and/or hybrid-bed type, depending on the feedstock to be treated. In the present patent application, the term hybrid bed refers to a mixed bed of catalysts with very different particle size distribution, simultaneously comprising at least one catalyst which is maintained in the reactor (typical functioning of an ebullating bed) and at least one entrained catalyst (slurry) which enters the reactor with the feedstock and which is entrained out of the reactor with the effluents (typical functioning of an entrained bed).

The invention is particularly well suited to ebullating-bed reactors. Thus, this stage is advantageously carried out using the technology and under the conditions of the H-Oil® process, as described, for example, in the U.S. Pat. Nos. 4,521,295 or 4,495,060 or 4,457,831 or in the paper by Aiche, Mar. 19-23, 1995, Houston, Tex., paper number 46d, "Second generation ebullated bed technology". Each reactor advantageously comprises a recirculation pump which makes it possible to maintain the catalyst in an ebullating bed by continuous recycling of at least one liquid fraction part advantageously withdrawn at the top of the reactor and reinjected at the bottom of the reactor.

In this stage a), said feedstock is transformed under specific hydroconversion conditions. Stage a) is carried out under an absolute pressure of between 2 MPa and 35 MPa, preferably between 5 MPa and 25 MPa and preferably between 6 MPa and 20 MPa, at a temperature of between 300° C. and 550° C. and preferably between 350° C. and 500° C. and preferably between 370° C. and 430° C. and more preferably between 380° C. and 430° C. The amount of hydrogen, advantageously mixed with the feedstock, is preferably between 50 $Sm^3/m^3$ and 5000 $Sm^3/m^3$ of liquid feedstock taken under standard temperature and pressure conditions, preferably between 100 $Sm^3/m^3$ and 2000 $Sm^3/m^3$ and very preferably between 200 $Sm^3/m^3$ and 1000 $Sm^3/m^3$.

The hydroconversion catalyst used in stage a) contains one or more elements from Groups 4 to 12 of the Periodic Table of the Elements, which are deposited on a support. Use may advantageously be made of a catalyst comprising a support, preferably an amorphous support, such as silica, alumina, silica/alumina, titanium dioxide or combinations of these structures, and very preferably alumina.

The catalyst contains at least one non-noble metal from Group VIII chosen from nickel and cobalt and preferably nickel and at least one metal from Group VIb chosen from molybdenum and tungsten and preferably the metal from Group VIb is molybdenum.

Advantageously, the hydroconversion catalyst of stage a) is a catalyst comprising an alumina support and at least one metal from Group VIII chosen from nickel and cobalt, preferably nickel, and at least one metal from Group VIb chosen from molybdenum and tungsten; preferably, the metal from Group VIb is molybdenum. Preferably, the hydroconversion catalyst comprises nickel and molybdenum.

Generally, the content of non-noble metal from Group VIII (in particular of nickel) is advantageously between 0.5% and 10%, expressed as weight of metal oxide (in particular NiO), and preferably between 1% and 6% by weight, and the content of metal from Group VIb (in particular molybdenum) is advantageously between 1% and 30%, expressed as weight of oxide of the metal (in particular $MoO_3$), and preferably between 4% and 20% by weight.

This catalyst is advantageously used in the form of extrudates or of beads.

The beads have, for example, a diameter of between 0.4 mm and 4.0 mm.

The extrudates have, for example, a cylindrical shape with a diameter of between 0.5 mm and 4.0 mm and with a length of between 1 mm and 5 mm. The extrudates can also be objects with a different shape, such as trilobes, tetralobes, which are regular or irregular, or other multilobes. Catalysts of other forms can also be used.

The size of these various forms of catalysts can be characterized by means of the equivalent diameter. The equivalent diameter is defined by six times the ratio of the volume of the particle to the external surface area of the particle. The catalyst used in the form of extrudates, beads or other forms thus has an equivalent diameter of between 0.4 mm and 4.4 mm.

These catalysts are well known to a person skilled in the art. The contents of metals are expressed with respect to the total weight of the catalyst.

In one of the embodiments according to the invention, the stage of deep hydroconversion a) is carried out in a hybrid bed, simultaneously comprising at least one catalyst which is maintained in the reactor and at least one entrained catalyst which enters the reactor with the feedstock and which is entrained out of the reactor with the effluents. In this case, the entrained catalyst, also known as slurry catalyst, is used in addition to the catalyst maintained in the ebullating-bed reactor in the process according to the invention. Said entrained catalyst exhibits, as difference from the catalyst maintained in the reactor, a particle size distribution and a density which are suitable for its entrainment. Entrainment of the catalyst is understood to mean its circulation in the three-phase reactor(s) by the liquid streams, said catalyst circulating from the bottom upwards, with the feedstock, in said three-phase reactor(s), and being withdrawn from said three-phase reactor(s) with the liquid effluent produced. As a result of its small size, which can vary between a few nanometers up to approximately a hundred micrometers (typically from 0.001 μm to 100 μm), the entrained catalyst is very well dispersed in the feedstock to be converted, thus greatly improving the hydrogenation and hydroconversion reactions in the whole of a reactor, reducing the formation of coke and increasing the conversion of the heavy fraction of the feedstock. These entrained catalysts are well known to a person skilled in the art.

The entrained catalyst can be formed and activated ex situ, outside the reactor, under conditions suitable for the activation, and then be injected with the feedstock. The entrained catalyst can also be formed and activated in situ, under the reaction conditions of one of the hydroconversion stages.

The entrained catalyst, or its precursor, is injected with the feedstock to be converted at the inlet of the reactor. The catalyst passes through the reactor with the feedstocks and the products being converted, and then it is entrained with the reaction products out of the reactor. The entrained catalysts exist either in the form of a powder (U.S. Pat. No. 4,303,634), which is the case for the entrained supported catalysts described below, or in the form of a "soluble" catalyst (U.S. Pat. No. 5,288,681). In the reactor, the entrained catalyst is in the form of dispersed solid particles, of colloids or of molecular entities dissolved in the feedstock, according to the nature of the catalyst. Such entrained catalysts and precursors which can be used in the process according to the invention are widely described in the literature.

The entrained catalysts used can be powders of heterogeneous solids (such as natural ores, iron sulfate, and the like), dispersed catalysts resulting from water-soluble precursors, such as phosphomolybdic acid, ammonium molybdate or a mixture of Mo or Ni oxide with aqueous ammonia, or resulting from precursors which are soluble in an organic phase. Preferably, the entrained catalysts used result from precursors which are soluble in an organic phase. The precursors which are soluble in an organic phase are preferably chosen from the group of organometallic compounds consisting of Mo, Co, Fe and Ni naphthenates, and multicarbonyl compounds of these metals, for example Mo or Ni 2-ethylhexanoates, Mo or Ni acetylacetonates, Mo or W salts of $C_7$-$C_{12}$ fatty acids, and the like. Preferably, the precursor is Mo naphthenate. The entrained catalysts can be used in the presence of a surfactant in order to improve the dispersion of the metals, in particular when the catalyst is a bimetallic catalyst.

According to one embodiment, "oil-soluble" entrained catalysts are used, and the precursor is mixed with a carbon feedstock (which may be a part of the feedstock to be treated, an external feedstock, and the like), the mixture is optionally dried, at least in part, and then or simultaneously it is sulfided by addition of a sulfur compound and heated. The preparations of these entrained catalysts are described in the prior art.

Additives can be added during the preparation of the entrained catalyst or to the entrained catalyst before it is injected into the reactor. These are for example a gas oil, an aromatic additive, solid particles, the size of which is preferably less than 1 mm, and the like. The preferred additives are inorganic oxides, such as alumina, silica or mixed Al/Si oxides, supported spent catalysts (for example, supported on alumina and/or silica) containing at least one element from Group VIII (such as Ni or Co) and/or at least one element from Group VIb (such as Mo or W). Mention will be made, for example, of the catalysts described in the patent US 2008/177124. Coke, optionally pretreated, can also be used. These additives are widely described in the literature. The entrained catalyst can advantageously be obtained by injection of at least one active phase precursor directly into the hydroconversion reactor(s) and/or into the feedstock prior to the introduction of said feedstock into the hydroconversion stage(s). The addition of precursor can be introduced continuously or batchwise (depending on the operation, on the type of feedstocks treated, on the product specifications sought and on the operability). According to one or more embodiments, the entrained catalyst precursor(s) is (are) premixed with a hydrocarbon oil composed, for example, of hydrocarbons, at least 50% by weight of which, with respect to the total weight of the hydrocarbon oil, have a boiling point of between 180° C. and 540° C., in order to form a dilute precursor premix. According to one or more embodiments, the precursor or the dilute precursor premix is dispersed in the heavy hydrocarbon feedstock, for example by dynamic mixing (for example using a rotor, a stirrer, and the like) or by static mixing (for example using an injector, by force feeding, via a static mixer, and the like), or merely added to the feedstock to obtain a mixture. Any mixing and stirring techniques known to a person skilled in the art can be used to disperse the precursor or the dilute precursor mixture in the feedstock of one or more hydroconversion stages.

Said active-phase precursor(s) of the unsupported catalyst can be in liquid form, such as, for example, precursors of metals which are soluble in organic media, such as, for example, molybdenum octoates and/or molybdenum naphthenates, or water-soluble compounds, such as, for example, phosphomolybdic acids and/or ammonium heptamolybdates, inter alia.

Said entrained catalyst can be formed and activated ex situ, outside the reactor, under conditions suitable for the activation, and then be injected with the feedstock. Said entrained catalyst can also be formed and activated in situ, under the reaction conditions of one of the hydroconversion stages.

According to one embodiment, said entrained catalyst can be supported, that is to say comprise a support for the active phase. In this case, the supported catalyst can advantageously be obtained:

- by grinding the fresh or spent supported hydroconversion catalyst or by grinding a mixture of fresh and spent catalysts, or
- by impregnation of at least one active-phase precursor on a support exhibiting a particle size distribution suitable for the entrainment thereof and preferably a size of between 0.001 μm and 100 μm.

Said entrained supported catalyst preferably comprises a support, such as silica, alumina, silica/alumina, titanium dioxide, clays, carbon, coal, coke, carbon black, lignite or combinations of these structures, and very preferably alumina.

The active phase of said entrained supported catalyst contains one or more elements from Groups 4 to 12 of the Periodic Table of the Elements, which may or may not be deposited on a support. The active phase of said entrained catalyst advantageously contains at least one metal from Group VIb chosen from molybdenum and tungsten, and preferably the metal from Group VIb is molybdenum. Said metal from Group VIb can be in combination with at least one non-noble metal from Group VIII chosen from nickel, cobalt, iron, ruthenium and preferably nickel.

In the present description, the groups of chemical elements are given according to the CAS classification (CRC Handbook of Chemistry and Physics, published by CRC Press, Editor in Chief D. R. Lide, 81st edition, 2000-2001). For example, the metals from Group VIII according to the CAS classification correspond to the metals from Columns 8, 9 and 10 according to the new IUPAC classification.

In the case of the entrained supported catalysts, the content of non-noble metal from Group VIII, in particular of nickel, is advantageously between 0.5% and 10%, expressed by weight of metal oxide (in particular of NiO), and preferably between 1% and 6% by weight. The content of metal from Group VIb, in particular of molybdenum, is advantageously between 1% and 30%, expressed by weight of oxide of the metal (in particular of molybdenum trioxide $MoO_3$), and preferably between 4% and 20% by weight. The contents of metals are expressed as percentage by weight of metal oxide, with respect to the weight of the entrained supported catalyst.

Advantageously, the entrained supported catalyst can additionally include at least one dopant chosen from phosphorus, boron and halogens (Group Vila or Group 17 of the new notation of the Periodic Table of the Elements), preferably phosphorus.

In one of the implementations of the process according to the invention, and in particular in an ebullating-bed reactor, each reactor of the hydroconversion stage a) can use a different catalyst suited to the feedstock which is sent to this reactor.

In one of the implementations of the process according to the invention, several different types of catalyst can be used in each reactor.

In a preferred implementation, each reactor of stage a) can contain one or more catalysts suitable for operation as an ebullating bed, and optionally one or more additional entrained catalysts.

According to common technology (described in the prior art, for example FR 3 033 797), the spent hydroconversion catalyst can be in part replaced by fresh catalyst by drawing off, the latter being preferably drawn off at the bottom of the reactor and the fresh catalyst being introduced into the reactor. The fresh catalyst can be replaced, in its entirety or in part, by spent catalyst and/or regenerated (coke-free) catalyst and/or rejuvenated catalyst (regenerated catalyst to which a compound which increases the activity of the catalyst has been added) and/or reactivated catalyst, reactivated via the extraction of the poisons and inhibitors, such as deposited metals resulting from hydrodemetallation reactions, and removal of the coke formed.

Separation Stage b)—Optional

The process preferably proceeds with stage b).

At least a part, and preferably all, of the effluent resulting from the hydroconversion stage a) can be subjected to one or more separation stages.

This separation stage is carried out with the objective of separating, from the effluent, at least one light fraction ("first light fraction") and thus obtaining at least one heavy liquid fraction, at least 80% by weight of which exhibits a boiling point of at least 250° C. and preferably of at least 300° C.

The light fraction can subsequently be sent, at least in part, to a fractionation section where it is subsequently advantageously separated from the light gases ($H_2$ and $C_1$-$C_4$), for example by passing through a flash drum. The hydrogen gas is recovered and is then advantageously recycled to the inlet of the deep hydroconversion stage a) or sent to the deep hydroconversion stage c) and/or to other units of the refinery. The light liquid fraction separated from the light gases can then advantageously be sent into the fractionation stage d). This light liquid fraction thus separated contains dissolved light gases, naphtha (fraction boiling at a temperature of less than 150° C.), kerosene (fraction boiling between 150° C. and 250° C.) and at least a part of the gas oil boiling between 250° C. and 375° C.

The heavy liquid fraction resulting from stage b) contains the compounds boiling at 250° C., preferably at 300° C., or more, and in particular those boiling from 375° C. and up to less than 540° C. (vacuum distillate) and those boiling at a temperature of 540° C. and more, which correspond to the vacuum residue (which is the unconverted fraction). It can thus contain a part of the gas oil fraction, that is to say compounds boiling between 250° C. and 375° C. This heavy liquid fraction is sent, in its entirety or in part, to the hydroconversion stage c).

The separation stage can be carried out by any separation means known to a person skilled in the art. Preferably, the separation stage b) is carried out by one or more flash drums in series and preferably by just one flash drum. Preferably, the flash drum is operated at a pressure and a temperature which are close to the operating conditions of the last reactor of the hydroconversion stage a).

In another implementation, the separation stage is carried out by a sequence of several flash drums, operating at different operating conditions from those of the last reactor of the hydroconversion stage a) and making it possible to obtain several light liquid fractions. The latter can subsequently be sent, in their entirety or in part, to a fractionation section.

In another implementation, the separation stage is carried out by one or more steam stripping and/or hydrogen stripping (entrainment) columns. By this means, the effluent resulting from the hydroconversion stage a) will be separated into a light fraction and a heavy liquid fraction.

In another implementation, the separation stage is carried out by an atmospheric distillation column, alone or followed by a vacuum distillation column.

The separation stage can also be a combination of these different implementations.

Optionally, before being sent to the hydroconversion stage c) according to the invention, the heavy liquid fraction can be subjected to a stage of separation of compounds having a boiling point of 540° C. or less. At least 80% by weight of the heavy fraction which is obtained exhibits a boiling point of at least 540° C. This separation can be carried out by steam stripping and/or hydrogen stripping, using one or more stripping columns.

The Second Deep Hydroconversion (Stage c))

The liquid effluent resulting from stage a) or the heavy fraction resulting from the separation stage b) is subjected to a deep hydroconversion in stage c). There may or may not be recycling of said effluent or of said fractions to stage a). Stages a) and c) are different stages carried out in separate zones.

The intervals of operating conditions, catalysts, employed are those described for stage a).

The operating conditions of stage c) are identical to or different from those of stage a).

In accordance with the invention, the overall hourly space velocity (HSV), that is to say the flow rate of liquid feedstock of the hydroconversion stage a), taken under standard temperature and pressure conditions, with respect to the total volume of the reactors of stages a) and c), is less than 0.1 $h^{-1}$, generally of at least 0.05 $h^{-1}$, preferably of between 0.05 $h^{-1}$ and 0.09 $h^{-1}$.

Fractionation Stage d)

The effluent resulting from the hydroconversion stage c) is subsequently subjected, in its entirety or in part, to a fractionation stage d). This fractionation can be carried out by one or more flash drums in series, preferably by a sequence of at least two successive flash drums, preferably by one or more steam stripping and/or hydrogen stripping columns, more preferably by an atmospheric distillation column, more preferably by an atmospheric distillation column and a vacuum column with regard to the atmospheric residue, more preferably still by one or more flash drums, an atmospheric distillation column and a vacuum column with regard to the atmospheric residue. This fractionation can also be carried out by a combination of the different separation means described above.

The fractionation stage is carried out with the objective of separating the light gases and the economically enhanceable distillates (gasoline, gas oil) and so as to obtain at least one heavy liquid fraction, at least 80% by weight of which boils at at least 300° C., or at at least 350° C., advantageously at at least 375° C., or at at least 400° C., or at at least 450° C., or at at least 500° C., and preferably a residue fraction, 80% by weight of which boils at at least 540° C. or more, is obtained. Preferably, a vacuum residue is separated (by atmospheric distillation and then vacuum distillation of the atmospheric residue), which residue has an initial boiling point of 540° C.

Deasphalting Stage e)

Said heavy liquid fraction obtained in stage d), and said residue fraction thereof, is subsequently subjected, in accordance with the process according to the invention, to a deasphalting stage e), in order to obtain a deasphalted hydrocarbon cut, referred to as DAO, and asphalt.

The deasphalting is generally carried out at a temperature of between 60° C. and 250° C. with at least one hydrocarbon solvent having from 3 to 7 carbon atoms; preferably, the solvent is butane, pentane or hexane, and also their mixtures, optionally with the addition of at least one additive. The solvent/feedstock ratios (volume/volume) in the deasphalting are generally between 4/1 and 9/1, often between 4/1 and 8/1.

The solvents which can be used and the additives are widely described. It is also possible and advantageous to carry out the recovery of the solvent according to the opticritical process, that is to say by using a solvent under supercritical conditions in the separation section. This process makes it possible in particular to considerably improve the overall economics of the process. This deasphalting can be carried out in one or more mixer-settlers or in one or more extraction columns.

It is possible to use a technique using at least one extraction column and preferably just one (for example, the Solvahl™ process).

The deasphalting unit produces a deasphalted hydrocarbon cut DAO (also known as deasphalted oil or deasphalting raffinate) which is virtually devoid of $C_7$ asphaltenes and a residual asphalt in which most of the impurities of the residue are concentrated and which is drawn off.

The DAO yield is generally between 40% and 90% by weight according to the quality of the heavy liquid fraction sent, the operating conditions and the solvent used.

The ranges of the typical operating conditions for the deasphalting as a function of the solvent are given in the following table:

| Solvent | Propane | Butane | Pentane | Hexane | Heptane |
|---|---|---|---|---|---|
| Pressure, MPa | 3-4 | 3-4 | 2-4 | 2-4 | 2-4 |
| Temperature, ° C. | 45-90 | 80-130 | 140-210 | 150-230 | 160-250 |
| Solvent/Feedstock Ratio, v/v | 6-10 | 5-8 | 3-6 | 3-6 | 3-5 |

The conditions of the deasphalting are suitable for the quality of the DAO to be obtained and for the feedstock entering the deasphalting.

These conditions make possible a significant reduction in the content of Conradson carbon and in the content of $C_7$ asphaltenes. The deasphalted hydrocarbon cut DAO obtained advantageously exhibits a content of $C_7$ asphaltenes of less than 0.5% by weight, preferably of less than 0.1% by weight and better still of less than 0.08% or than 0.07% by weight, with respect to the total weight of said cut.

In one embodiment, all or preferably a part of said deasphalted fraction DAO is recycled to stage a) and/or to stage c).

Conversion of the DAO Fraction (Stage f))

The DAO fraction can be sent, in its entirety or in part, into an additional conversion stage f). Preferably, the DAO is sent directly into the conversion stage. Preferably, all of the DAO fraction is sent directly to the conversion stage, that is to say that it is not subjected to any treatment except optionally one or more fractionation stages.

This stage makes it possible to bring the conversion of the process to a very high level (with respect to the 540° C.+ cut) and most often to more than 90%. The conversion processes targeted in this stage are fixed-bed hydrocracking, fluidized-bed catalytic cracking FCC or ebullating-bed hydroconversion (H-Oil DC); these conversion processes can be preceded by a hydrotreating.

If need be, said deasphalted hydrocarbon cut DAO can be subjected to an atmospheric distillation, optionally followed by a vacuum distillation, in particular when stage c) does not comprise a distillation.

The cuts of economically enhanceable products obtained are the gasoline cut (150° C.−), one or more middle distillate cuts (150-375° C.) and one or more heavier fractions having a boiling point of 375° C. or more.

This (these) heavier fraction(s) is (are) preferably sent into the conversion stage f).

The characteristics of this fraction are particularly advantageous (low Conradson carbon, low content of $C_7$ asphaltenes, low contents of S, metals).

In one embodiment, the deasphalted hydrocarbon cut DAO is advantageously distilled as a mixture with at least a part and preferably all of the light liquid fraction resulting from stage b).

In another embodiment, said mixture can be sent into the conversion stage f) without prior fractionation (distillation).

For the distillation, the DAO may also have been mixed with a feedstock external to the process, such as, for example, vacuum distillate, atmospheric residue or vacuum residue cuts resulting from the primary fractionation (of the crude oil) of the refinery.

The process preferably proceeds without distillation. The DAO fraction, in part or in its entirety, is then sent as is into stage f).

The conversion stage can be a fixed-bed hydrocracking. It can advantageously take place in one or more reactors or in just one reactor comprising one or more catalytic beds.

The fixed-bed hydrocracking employs an acid catalyst in the presence of hydrogen.

The presence of nitrogen and other impurities in said mixture requires a prior pretreatment in order to prevent the deactivation of the catalyst. Thus, use is generally made of at least one fixed bed of hydrotreating catalyst, followed by at least one fixed bed of a hydrocracking catalyst. These catalysts are well known to a person skilled in the art. It is preferably possible to employ one of the catalysts described by the Applicant Company in the patents EP B 113 297 and EP B 113 284.

The catalysts contain at least one non-noble element from Group VIII (Ni and/or Co) and at least one element from Group VIb (Mo and/or W). The content of elements from Group VIII is advantageously between 1% and 10% by weight of oxides, with respect to the total weight of the catalyst, preferably between 1.5% and 9% by weight and very preferably between 2% and 8% by weight. The contents of the elements from Group VIb are advantageously between 5% and 40% by weight of oxides, with respect to the total weight of the catalyst, preferably between 8% and 37% by weight and very preferably between 10% and 35% by weight. The contents are expressed with respect to the total weight of the catalyst.

The support of the hydrotreating catalysts is generally alumina; that of the hydrocracking catalysts contains one or more zeolites (most often zeolite Y or zeolite β), generally as a mixture with alumina and/or silica/alumina. The contents by weight of zeolite are generally less than 80% by weight.

The hydrotreating and hydrocracking catalysts can also contain at least one organic additive.

The operation is preferably carried out under an absolute pressure of between 5 MPa and 35 MPa and preferably between 10 MPa and 20 MPa, at a temperature advantageously of between 300° C. and 500° C. and preferably between 350° C. and 450° C. The HSV and the partial hydrogen pressure are chosen as a function of the characteristics of the feedstock to be treated and of the desired conversion. Preferably, the HSV is between 0.1 $h^{-1}$ and 5 $h^{-1}$ and preferably between 0.15 $h^{-1}$ and 2 $h^{-1}$. The amount of hydrogen, advantageously mixed with the feedstock, is preferably between 100 $Sm^3/m^3$ and 1000 $Sm^3/m^3$ of liquid feedstock and preferably between 500 $Sm^3/m^3$ and 3000 $Sm^3/m^3$.

The stage of ebullating-bed hydroconversion which treats the DAO fraction (H-Oil® DC) can advantageously be carried out under an absolute pressure of between 2 MPa and 35 MPa, preferably between 5 MPa and 25 MPa and preferably between 6 MPa and 20 MPa, at a temperature of between 300° C. and 550° C., preferably of between 350° C. and 500° C., preferably of between 380° C. and 470° C. and more preferably of between 400° C. and 450° C. The amount of hydrogen, advantageously mixed with the feedstock, is preferably between 50 $Sm^3/m^3$ and 5000 $Sm^3/m^3$ of liquid feedstock, taken under standard temperature and pressure conditions, preferably between 100 $Sm^3/m^3$ and 2000 $Sm^3/m^3$ and very preferably between 200 $Sm^3/m^3$ and 1000 $Sm^3/m^3$. Preferably, the HSV of this stage is between 0.1 $h^{-1}$ and 10 $h^{-1}$ and preferably between 0.15 $h^{-1}$ and 5 $h^{-1}$.

The hydroconversion catalyst used in an ebullating bed contains one or more elements from Groups 4 to 12 of the Periodic Table of the Elements, which are deposited on a support. Use may advantageously be made of a catalyst comprising a support, preferably an amorphous support, such as silica, alumina, silica/alumina, titanium dioxide or combinations of these structures, and very preferably alumina. The catalyst contains at least one metal from Group VIII chosen from nickel and cobalt and preferably nickel and at least one metal from Group VIb chosen from molybdenum and tungsten and preferably the metal from Group VIb is molybdenum.

Advantageously, the hydroconversion catalyst is a catalyst comprising an alumina support and at least one metal from Group VIII chosen from nickel and cobalt, preferably nickel, and at least one metal from Group VIb chosen from molybdenum and tungsten; preferably, the metal from Group VIb is molybdenum. Preferably, the hydroconversion catalyst comprises nickel and molybdenum.

The nickel content is advantageously between 0.5% by weight and 10% by weight, expressed by weight of nickel oxide (NiO), and preferably between 1% by weight and 6% by weight, and the molybdenum content is advantageously between 1% by weight and 30% by weight, expressed by weight of molybdenum trioxide ($MoO_3$), and preferably between 4% by weight and 20% by weight. The contents are expressed with respect to the total weight of the catalyst.

This catalyst is advantageously used in the form of extrudates or of beads. The extrudates have, for example, a diameter of between 0.5 mm and 2.0 mm and a length of between 1 mm and 5 mm. These catalysts are well known to a person skilled in the art.

According to common technology (described in the prior art, for example FR 3 033 797), the spent hydroconversion catalyst can be in part replaced by fresh catalyst by drawing off, the latter being preferably drawn off at the bottom of the reactor and the fresh catalyst being introduced into the reactor. The fresh catalyst can be replaced, in its entirety or in part, by spent catalyst and/or regenerated (coke-free) catalyst and/or rejuvenated catalyst (regenerated catalyst to which a compound which increases the activity of the catalyst has been added) and/or reactivated catalyst, reactivated via the extraction of the poisons and inhibitors, such as deposited metals resulting from hydrodemetallation reactions, and removal of the coke formed.

The effluent resulting from the conversion stage f) is subsequently generally distilled, so as to recover the economically enhanceable gasoline and gas oil cuts. The residual unconverted fraction can be recycled to one of the stages of the process.

In another embodiment, the conversion stage f) can be carried out through a fluidized-bed catalytic cracking unit. The DAO can be treated by coprocessing with one or more heavy feedstocks of VGO, HDT VGO or residue type, or alone.

The fluidized-bed catalytic cracking unit can comprise just one reactor treating both the heavy feedstock and the DAO or only the DAO, or two distinct reactors, one treating the heavy feedstock and the other the DAO. Furthermore, each of the reactors can be an upflow reactor or a downflow reactor. Most often, the two reactors will have the same mode of flow.

When the catalytic cracking is carried out by coprocessing of one or more heavy feedstocks and of a DAO:

1) in a single upflow reactor, the reactor outlet temperature (ROT) is between 450° C. and 650° C., preferably between 470° C. and 620° C., and the C/O ratio is between 2 and 20 and preferably between 4 and 15.
2) in a single downflow reactor, the reactor outlet temperature (ROT) is between 480° C. and 650° C. and the C/O ratio is between 10 and 50.
3) in two distinct upflow reactors, the first reactor, which carries out the cracking of the heavy feedstock or feedstocks, operates at a reactor outlet temperature (ROT1) of between 450° C. and 650° C., preferably of between 470° C. and 620° C., and a C/O ratio of between 2 and 20, preferably between 4 and 15. The second reactor, which carries out the cracking of the DAO, operates at a reactor outlet temperature (ROT2) of between 500° C. and 600° C., preferably of between 520° C. and 580° C., with a C/O ratio of between 2 and 20.
4) in two distinct downflow FCC reactors, the first FCC reactor, which carries out the cracking of the heavy feedstock or feedstocks, operates at a reactor outlet temperature (ROT1) of between 480° C. and 650° C., with a C/O ratio of between 10 and 50. The second FCC reactor, which carries out the cracking of the DAO, operates at a reactor outlet temperature (ROT2) of between 570° C. and 600° C., with a C/O ratio of between 10 and 50.

When the catalytic cracking is carried out on the DAO alone:

1) in an upflow reactor, the reactor operates at a reactor outlet temperature (ROT) of between 500° C. and 600° C., preferably of between 520° C. and 580° C., with a C/O ratio of between 2 and 20.
2) in a downflow reactor, the reactor operates at a reactor outlet temperature (ROT2) of between 570° C. and 600° C., with a C/O ratio of between 10 and 50.

The streams of spent catalyst which result from the two FCC reactors are separated from the cracking effluents by any gas/solid separation system known to a person skilled in the art and are regenerated in a common regeneration zone.

The effluent from the catalytic cracking reactor (or else the two effluents, if there are two reactors) is sent into a fractionation zone. This unit for separation of the generally comprises a primary separation of the effluents, making possible, inter alia, the production of economically enhanceable cuts, such as gasoline, middle distillate and heavy distillate cuts. The residual unconverted fraction can be recycled to one of the stages of the process.

The catalyst of the fluidized-bed catalytic cracking stage typically consists of particles with a mean diameter generally of between 40 micrometers and 140 micrometers and most often of between 50 micrometers and 120 micrometers.

The catalytic cracking catalyst contains at least one appropriate matrix, such as alumina, silica or silica/alumina, with or without the presence of a zeolite of type Y dispersed in this matrix.

The catalyst can additionally comprise at least one zeolite exhibiting a shape selectivity of one of the following structural types: MEL (for example ZSM-11), MFI (for example ZSM-5), NES, EUO, FER, CHA (for example SAPO-34), MFS or MWW. It can also comprise one of the following zeolites: NU-85, NU-86, NU-88 and IM-5, which also exhibit a shape selectivity.

The advantage of these zeolites exhibiting a shape selectivity is that a better propylene/isobutene selectivity, that is to say a higher propylene/isobutene ratio, is obtained in the cracking effluents.

The proportion of zeolite exhibiting a shape selectivity, with respect to the total amount of zeolite, can vary as a function of the feedstocks used and of the structure of the desired products. Often, use is made of 0.1% to 60%, preferably of 0.1% to 40% and in particular of 0.1% to 30%, by weight, of zeolite exhibiting a shape selectivity.

The zeolite or zeolites can be dispersed in a matrix based on silica, on alumina or on silica/alumina, the proportion of zeolite (all zeolites combined), with respect to the weight of the catalyst, often being between 0.7% and 80% by weight, preferably between 1% and 50% by weight and more preferably between 5% and 40% by weight.

In the case where several zeolites are used, they can be incorporated in just one matrix or in several different matrices. The content of zeolite exhibiting a shape selectivity in the total inventory is less than 30% by weight.

The catalyst used in the catalytic cracking reactor can be composed of an ultrastable zeolite of type Y dispersed in an alumina, silica or silica/alumina matrix, to which an additive based on zeolite ZSM5 is added, the amount of ZSM5 crystals in the total inventory being less than 30% by weight.

DESCRIPTION OF THE FIGURE

FIG. 1 illustrates the invention.

It comprises a deep hydroconversion section A in which the deep hydroconversion stage a) is carried out. The feedstock 1 is converted in the presence of hydrogen 2 and the resulting effluent 3 is separated (stage b), optionally followed by stage b')) in the separation section B. A light fraction 4 and a heavy fraction 5 are obtained. The latter is sent into the deep hydroconversion section C, where it is subjected to the stage c) of deep hydroconversion in the presence of hydrogen 6. A light fraction 8 and a heavy fraction 9 are separated from the resulting effluent 7 and the heavy fraction 9 is directed to the deasphalting section E where the deasphalting stage e) is carried out using a solvent 12. The deasphalted oil DAO 10 is sent to a conversion section F where the conversion stage f) takes place and the asphalt 11 is recovered. The effluent 13 resulting from the conversion stage f) is subsequently generally sent into a separation stage, so as to recover the economically enhanceable cuts, for example gasoline and gas oil.

EXAMPLES

Examples 1 and 2 are compared at the same conversion (75% of 540° C.+ into 540° C.−) and examples 3 and 4 are carried out at the same temperature. Examples 5 and 6 are compared at the same conversion (75% of 540° C.+ into 540° C.−) and examples 7 and 8 are carried out at the same temperature.

Feedstock

The heavy feedstock is a vacuum residue (VR) originating from a Urals crude oil, the main characteristics of which are presented in table 1 below. This VR heavy feedstock is the same fresh feedstock for the different examples.

TABLE 1

Composition of the feedstock of the process

| Feedstock of stage | | A |
|---|---|---|
| Feedstock | | Urals VR |
| Density | | 1.000 |
| 540° C. + content | % by weight | 77.9 |
| Viscosity at 100° C. | cSt | 880 |
| Conradson carbon | % by weight | 17.0 |
| $C_7$ Asphaltenes | % by weight | 6.8 |
| Nickel + Vanadium | ppm | 233 |
| Nitrogen | ppm | 6010 |
| Sulfur | % by weight | 2.715 |

Example 1 not in Accordance with the Invention

Scheme having a high hourly space velocity and high temperature (overall HSV=0.3 $h^{-1}$+431/431° C.)+deasphalting stage (SDA)

In this example, two ebullating-bed reactors (first and second deep hydroconversion section) are positioned in series, operated at high hourly space velocity (HSV) and high temperature with an inter-step separation section and a downstream deasphalting process.

Hydroconversion Section A

The fresh feedstock of table 1 is sent in its entirety into the first ebullating-bed hydroconversion section A, in the presence of hydrogen, which section comprises a three-phase reactor a NiMo/alumina hydroconversion catalyst exhibiting a NiO content of 4% by weight and a $MoO_3$ content of 9% by weight, the percentages being expressed with respect to the total weight of the catalyst. The section operates as an ebullating bed having upflow of liquid and of gas.

The conditions applied in the hydroconversion section A are presented in table 2.

TABLE 2

Operating conditions of the hydroconversion section A

| Section | | A |
|---|---|---|
| Total P | MPa | 16 |
| Temperature | ° C. | 431 |
| Amount of hydrogen | $Sm^3/m^3$ | 500 |

These operating conditions make it possible to obtain a liquid effluent having a reduced content of Conradson carbon, of metals and of sulfur.

Separation Section B

The liquid effluent resulting from section A is subsequently sent into a separation section B composed of a single gas/liquid separator operating at the pressure and at the temperature of the reactor of the first hydroconversion section A. A "light" fraction and a "heavy" fraction are thus separated. The "light" fraction is predominantly composed of molecules having a boiling point of less than 350° C. and the "heavy" fraction is predominantly composed of hydrocarbon molecules boiling at a temperature of at least 350° C.

Hydroconversion Section C

The heavy fraction resulting from the separation section B is sent, alone and in its entirety, into a second hydroconversion section C in the presence of hydrogen. Said section comprises a three-phase reactor containing a NiMo/alumina hydroconversion catalyst exhibiting a NiO content of 4% by weight and a $MoO_3$ content of 9% by weight, the percentages being expressed with respect to the total weight of the catalyst. The section operates as an ebullating bed having upflow of liquid and of gas.

The conditions applied in the hydroconversion section C are presented in table 4.

TABLE 4

Operating conditions of the hydroconversion section C

| Section | | C |
|---|---|---|
| Total P | MPa | 15.6 |
| Temperature | ° C. | 431 |
| Amount of hydrogen | $Sm^3/m^3$ | 300 |

Fractionation Section D

The effluent from the hydroconversion section C is sent into a fractionation section D composed of an atmospheric distillation, followed by a vacuum distillation, from which an unconverted vacuum residue (VR) heavy fraction boiling at a temperature of at least 540° C. is recovered, the yields with respect to the fresh feedstock and the quality of which are given in table 5 below.

TABLE 5

Yield and quality of the VR resulting from the fractionation section D

| Fraction | | Unconverted vacuum residue |
|---|---|---|
| Yield with respect to the fresh feedstock (A) | % by weight | 19.42 |
| 540° C. + content | % by weight | 100 |
| Density | $g/cm^3$ | 1.0157 |

TABLE 5-continued

Yield and quality of the VR resulting from the fractionation section D

| Fraction | | Unconverted vacuum residue |
|---|---|---|
| Conradson carbon | % by weight | 22.2 |
| Nickel + Vanadium | ppm | 91.4 |
| Nitrogen | ppm | 8870 |
| Sulfur | % by weight | 1.028 |
| Saturates | % by weight | 15.5 |
| Aromatics | % by weight | 36.2 |
| Resins | % by weight | 38.9 |
| $C_7$ Asphaltenes | % by weight | 9.4 |

Deasphalting Section E

The vacuum residue resulting from section D is sent into the deasphalting section E. The conditions applied in the deasphalting unit are described in table 6.

TABLE 6

Operating conditions in the SDA unit E

| Feedstock | | Vacuum residue resulting from section D |
|---|---|---|
| Solvent | | Butane |
| Extractor pressure | MPa | 3.0 |
| $T_{mean}$ extractor | ° C. | 95 |
| Solvent/feedstock ratio | v/v | 8 |

On conclusion of section E, a DAO fraction, which can be economically enhanced in a conversion process (fixed-bed hydrocracking, FCC or recycling to the process for hydroconversion under mild conditions in an ebullating bed), and an "asphalt" fraction, which is difficult to economically enhance, are obtained. The yields and qualities of these two products are given in table 7.

TABLE 7

Yields and qualities of the effluents resulting from the deasphalting section E

| Fraction | | DAO | Asphalt |
|---|---|---|---|
| Yield with respect to the unconverted VR (D) | % by weight | 49.9 | 50.1 |
| Yield with respect to the fresh feedstock (A) | % by weight | 9.7 | 9.7 |
| Density | $g/cm^3$ | 0.9474 | 1.0942 |
| Conradson carbon | % by weight | 7.42 | 36.9 |
| $C_7$ Asphaltenes | % by weight | 0.09 | 18.7 |
| Nickel + Vanadium | ppm | <2 | 181 |
| Nitrogen | ppm | 4520 | 13 210 |
| Sulfur | % by weight | 0.836 | 1.220 |

Overall Performance Qualities

With this scheme not in accordance with the invention, for an overall hourly space velocity (HSV) of 0.3 $h^{-1}$ and high temperatures (431/431° C.), the conversion of the heavy 540° C.+ cut is 75.1% by weight before the deasphalting stage. Furthermore, the unconverted VR contains high contents of Conradson carbon and $C_7$ asphaltenes (respectively 22.2% by weight and 9.4% by weight), implying that only 49.9% by weight of the unconverted VR is recoverable in the form of DAO. Thus, this conventional scheme is accompanied by a significant generation of asphalt of 9.7% by weight, with respect to the fresh starting feedstock. If the DAO cut is subsequently completely converted in a hydrocracking unit, the total conversion of the heavy 540° C.+ cut in the complete scheme is 87.5% by weight.

Example 2 According to the Invention

Scheme according to the invention having a low hourly space velocity (overall HSV=0.089 $h^{-1}$+411/411° C.) and having a low temperature+SDA In this example, the present invention is illustrated in a process scheme with two ebullating-bed reactors positioned in series, operated at low hourly space velocity (HSV=0.089 $h^{-1}$) and at low temperature (411/411° C.) and with an inter-step separation section and a downstream deasphalting process, as described in connection with FIG. 1.

Hydroconversion Section A

The fresh feedstock of table 1 is sent in its entirety into the first ebullating-bed hydroconversion section A, in the presence of hydrogen, which section comprises a three-phase reactor containing a NiMo/alumina hydroconversion catalyst exhibiting a NiO content of 4% by weight and a $MoO_3$ content of 9% by weight, the percentages being expressed with respect to the total weight of the catalyst. The section operates as an ebullating bed having upflow of liquid and of gas.

The conditions applied in the hydroconversion section A are presented in table 8.

TABLE 8

Operating conditions of the hydroconversion section A

| Section | | A |
|---|---|---|
| Total P | MPa | 16 |
| Temperature | ° C. | 411 |
| Amount of hydrogen | $Sm^3/m^3$ | 600 |

Separation Section B

The liquid effluent resulting from section A is subsequently sent into a separation section B composed of a single gas/liquid separator operating at the pressure and at the temperature of the reactors of the first hydroconversion section A. A "light" fraction and a "heavy" fraction are thus separated. The "light" fraction is predominantly composed of molecules having a boiling point of less than 350° C. and the "heavy" fraction is predominantly composed of hydrocarbon molecules boiling at a temperature of at least 350° C.

Hydroconversion Section C

The heavy fraction resulting from the separation section B is sent, alone and in its entirety, into a second ebullating-bed hydroconversion section C, in the presence of hydrogen. Said section comprises a three-phase reactor containing a NiMo/alumina hydroconversion catalyst exhibiting a NiO content of 4% by weight and a $MoO_3$ content of 9% by weight, the percentages being expressed with respect to the total weight of the catalyst. The section operates as an ebullating bed having upflow of liquid and of gas.

These operating conditions make it possible to obtain a liquid effluent having a reduced content of Conradson carbon, of metals and of sulfur.

The conditions applied in the hydroconversion section C are presented in table 9.

TABLE 9

Operating conditions of the hydroconversion section C

| Section | | C |
|---|---|---|
| Total P | MPa | 15.6 |
| Temperature | ° C. | 411 |
| Amount of hydrogen | $Sm^3/m^3$ | 250 |

Fractionation Section D

The effluent from the hydroconversion section C is sent into a fractionation section D composed of an atmospheric distillation, followed by a vacuum distillation, from which an unconverted vacuum residue (VR) heavy fraction boiling at a temperature of at least 540° C. is recovered, the yields with respect to the fresh feedstock and the quality of which are given in table 10 below.

TABLE 10

Yield and quality of the VR resulting from the fractionation section D

| Fraction | | Unconverted vacuum residue |
|---|---|---|
| Yield with respect to the fresh feedstock (A) | % by weight | 19.33 |
| Content of 540° C.+ | % by weight | 100 |
| Density | $g/cm^3$ | 0.9924 |
| Conradson carbon | % by weight | 16.4 |
| Nickel + Vanadium | ppm | 21.7 |
| Nitrogen | ppm | 7120 |
| Sulfur | % by weight | 0.687 |
| Saturates | % by weight | 19.0 |
| Aromatics | % by weight | 41.6 |
| Resins | % by weight | 34.9 |
| $C_7$ Asphaltenes | % by weight | 4.6 |

Deasphalting Section E

The vacuum residue resulting from section D is sent into the deasphalting section E. The conditions applied in the deasphalting unit described in table 11.

TABLE 11

Operating conditions in the SDA unit E

| Feedstock | | Vacuum residue resulting from section D |
|---|---|---|
| Solvent | | butane |
| Extractor pressure | MPa | 3.0 |
| $T_{mean}$ extractor | ° C. | 95 |
| Solvent/feedstock ratio | v/v | 8 |

On conclusion of section E, a DAO fraction, which can be economically enhanced in a conversion process (fixed-bed hydrocracking, FCC or recycling to the process for hydroconversion under mild conditions in an ebullating bed), and an "asphalt" fraction, which is difficult to economically enhance, are obtained.

The yields and qualities of these two products are given in table 12.

TABLE 12

Yields and qualities of the effluents resulting from the deasphalting section E

| Fraction | | DAO | Asphalt |
|---|---|---|---|
| Yield with respect to the unconverted VR (D) | % by weight | 68.2 | 31.8 |
| Yield with respect to the fresh feedstock (A) | % by weight | 13.2 | 6.1 |
| Density | g/cm$^3$ | 0.9495 | 1.0988 |
| Conradson carbon | % by weight | 8.1 | 34.1 |
| $C_7$ Asphaltenes | % by weight | 0.07 | 14.2 |
| Nickel + Vanadium | ppm | <2 | 67.4 |
| Nitrogen | ppm | 4590 | 12 530 |
| Sulfur | % by weight | 0.610 | 0.849 |

Overall Performance Qualities

With this scheme according to the invention having an overall HSV=0.089 h$^{-1}$, the conversion of the heavy 540° C.+ cut is 75.2% by weight before the deasphalting stage, i.e. comparable to example 1. However, the unconverted VR contains lower contents of Conradson carbon and $C_7$ asphaltenes in comparison with example 1, which makes it possible to recover a greater amount of DAO from the unconverted VR (68.2% by weight recoverable in this example, versus 49.9% by weight in example 1). Thus, this scheme according to the invention is accompanied by a lower generation of asphalt corresponding to 6.1% by weight, with respect to the fresh starting feedstock. If all of the DAO is converted in a hydrocracking unit, then an overall conversion of 92.1% by weight of the starting heavy 540° C.+ cut can thus be obtained by virtue of this example according to the invention, i.e. 4.6 conversion points more than in example 1. The scheme according to the invention thus makes it possible to exceed a conversion of 90% by weight, with respect to the fresh feedstock.

Example 3 not in Accordance with the Invention

Scheme having a high hourly space velocity and having a moderate temperature (overall HSV=0.3 h$^{-1}$+420/420° C.)+ SDA deasphalting stage In this example, the operation is carried out with two ebullating-bed reactors positioned in series (first and second deep hydroconversions), which are operated at high hourly space velocity (HSV) and at moderate temperature (420° C.) with an inter-step separation section and a downstream deasphalting process.

Hydroconversion Section A

The fresh feedstock of table 1 is sent, in its entirety, into an ebullating-bed hydroconversion section A, in the presence of hydrogen. The three-phase reactor contains a NiMo/alumina hydroconversion catalyst exhibiting a NiO content of 4% by weight and a $MoO_3$ content of 9% by weight, the percentages being expressed with respect to the total weight of the catalyst. The section operates as an ebullating bed having upflow of liquid and of gas.

The conditions applied in the hydroconversion section A are presented in table 13.

TABLE 13

Operating conditions of the hydroconversion section A

| Section | | A |
|---|---|---|
| Total P | MPa | 16 |
| Temperature | ° C. | 420 |
| Amount of hydrogen | Sm$^3$/m$^3$ | 350 |

These operating conditions make it possible to obtain a liquid effluent having a reduced content of Conradson carbon, of metals and of sulfur.

Separation Section B

The liquid effluent resulting from section A is subsequently sent into a separation section B composed of a single gas/liquid separator operating at the pressure and at the temperature of the reactors of the first hydroconversion section A. A "light" fraction and a "heavy" fraction are thus separated. The "light" fraction is predominantly composed of molecules having a boiling point of less than 350° C. and the "heavy" fraction is predominantly composed of hydrocarbon molecules boiling at a temperature of at least 350° C.

Hydroconversion Section C

The heavy fraction resulting from the separation section B is sent, alone and in its entirety, into a second ebullating-bed hydroconversion section C, in the presence of hydrogen. Said section comprises a three-phase reactor containing a NiMo/alumina hydroconversion catalyst exhibiting a NiO content of 4% by weight and a $MoO_3$ content of 9% by weight, the percentages being expressed with respect to the total weight of the catalyst. The section operates as an ebullating bed having upflow of liquid and of gas.

The conditions applied in the hydroconversion section C are presented in table 14.

TABLE 14

Operating conditions of the hydroconversion section C

| Section | | C |
|---|---|---|
| Total P | MPa | 15.6 |
| Temperature | ° C. | 420 |
| Amount of hydrogen | Sm$^3$/m$^3$ | 200 |

Fractionation Section D

The effluent from the hydroconversion section C is sent into a fractionation section D composed of an atmospheric distillation, followed by a vacuum distillation, from which an unconverted vacuum residue (VR) heavy fraction boiling at a temperature of at least 540° C. is recovered, the yields with respect to the fresh feedstock and the quality of which are given in table 15 below.

TABLE 15

Yield and quality of the VR resulting from the fractionation section D

| Fraction | | Unconverted vacuum residue |
|---|---|---|
| Yield with respect to the fresh feedstock (A) | % by weight | 31.75 |
| 540° C. + content | % by weight | 100 |
| Density | g/cm$^3$ | 1.0098 |
| Conradson carbon | % by weight | 20.7 |
| Nickel + Vanadium | ppm | 98.0 |
| Nitrogen | ppm | 8230 |
| Sulfur | % by weight | 1.246 |
| Saturates | % by weight | 16.4 |
| Aromatics | % by weight | 37.5 |
| Resins | % by weight | 37.9 |
| $C_7$ Asphaltenes | % by weight | 8.2 |

Deasphalting Section E

The vacuum residue resulting from section D is sent into the deasphalting section E.

The conditions applied in the deasphalting unit described in table 16.

TABLE 16

| Operating conditions in the SDA unit E | | |
|---|---|---|
| Feedstock | | Vacuum residue resulting from section D |
| Solvent | | butane |
| Extractor pressure | MPa | 3.0 |
| $T_{mean}$ extractor | ° C. | 95 |
| Solvent/feedstock ratio | v/v | 8 |

On conclusion of section E, a DAO fraction, which can be economically enhanced in a conversion process (hydrocracking, FCC or recycling to the hydroconversion process), and an "asphalt" fraction, which is difficult to economically enhance, are obtained. The yields and qualities of these two products are given in table 17.

TABLE 17

| Yields and qualities of the effluents resulting from the deasphalting section E | | | |
|---|---|---|---|
| Fraction | | DAO | Asphalt |
| Yield with respect to the unconverted VR | % by weight | 54.1 | 45.9 |
| Yield with respect to the fresh feedstock (A) | % by weight | 17.2 | 14.6 |
| Density | g/cm$^3$ | 0.9478 | 1.0943 |
| Conradson carbon | % by weight | 7.53 | 36.3 |
| $C_7$ Asphaltenes | % by weight | 0.08 | 17.8 |
| Nickel + Vanadium | ppm | <2 | 212.4 |
| Nitrogen | ppm | 4420 | 12 730 |
| Sulfur | % by weight | 1.036 | 1.493 |

Overall Performance Qualities

With this scheme, for an overall hourly space velocity (HSV) of 0.3 h$^{-1}$ and moderate temperatures (420/420° C.), the conversion of the heavy 540° C.+ cut is 59.2% by weight before the deasphalting stage. Furthermore, the unconverted VR contains high contents of Conradson carbon and 07 asphaltenes (respectively 20.7% by weight and 8.2% by weight), implying that only 54.1% by weight of the unconverted VR is recoverable in the form of DAO. Thus, this conventional scheme is accompanied by a significant generation of asphalt of 14.6% by weight, with respect to the fresh starting feedstock. Even if all of the DAO is converted in a hydrocracking unit, this sequence according to the prior art only corresponds to an overall conversion of 81.3% by weight of the starting heavy 540° C.+ cut. It thus does not make it possible to achieve levels of conversion of the heavy 540° C.+ cut of greater than 90% by weight.

Example 4 According to the Invention

Scheme according to the invention having a low hourly space velocity (overall HSV=0.089 h$^{-1}$+420/420° C.) and having a low temperature+SDA deasphalting stage In this example, the present invention is illustrated in a process scheme with two ebullating-bed reactors positioned in series, operated at low hourly space velocity (HSV=0.089 h$^{-1}$) and at moderate temperature (420/420° C.) and with an inter-step separation section and a downstream deasphalting process, according to the scheme of FIG. 1.

Hydroconversion Section A

The fresh feedstock of table 1 is sent, in its entirety, into an ebullating-bed hydroconversion section A, in the presence of hydrogen. Said section comprises a three-phase reactor containing a NiMo/alumina hydroconversion catalyst exhibiting a NiO content of 4% by weight and a $MoO_3$ content of 9% by weight, the percentages being expressed with respect to the total weight of the catalyst. The section operates as an ebullating bed having upflow of liquid and of gas. The conditions applied in the hydroconversion section A are presented in table 18.

TABLE 18

| Operating conditions of the hydroconversion section A | | |
|---|---|---|
| Section | | A |
| Total P | MPa | 16 |
| Temperature | ° C. | 420 |
| Amount of hydrogen | Sm$^3$/m$^3$ | 700 |

These operating conditions make it possible to obtain a liquid effluent having a reduced content of Conradson carbon, of metals and of sulfur.

Separation Section B

The liquid effluent resulting from section A is subsequently sent into a separation section B composed of a single gas/liquid separator operating at the pressure and at the temperature of the reactors of the first hydroconversion section A. A "light" fraction and a "heavy" fraction are thus separated. The "light" fraction is predominantly composed of molecules having a boiling point of less than 350° C. and the "heavy" fraction is composed of hydrocarbon molecules boiling at a temperature of at least 350° C.

Hydroconversion Section C

In this reference scheme, the heavy fraction resulting from the separation section B is sent, alone and in its entirety, into a second ebullating-bed hydroconversion section C, in the presence of hydrogen. Said section comprises a three-phase reactor containing a NiMo/alumina hydroconversion catalyst exhibiting a NiO content of 4% by weight and a $MoO_3$ content of 9% by weight, the percentages being expressed with respect to the total weight of the catalyst. The section operates as an ebullating bed having upflow of liquid and of gas. The conditions applied in the hydroconversion section C are presented in table 19.

TABLE 19

| Operating conditions of the hydroconversion section C | | |
|---|---|---|
| Section | | C |
| Total P | MPa | 15.6 |
| Temperature | ° C. | 420 |
| Amount of hydrogen | Sm$^3$/m$^3$ | 350 |

Fractionation Section D

The effluent from the hydroconversion section C is sent into a fractionation section D composed of an atmospheric distillation, followed by a vacuum distillation, from which an unconverted vacuum residue (VR) heavy fraction boiling at a temperature of at least 540° C. is recovered, the yields with respect to the fresh feedstock and the quality of which are given in table 20 below.

TABLE 20

| Yield and quality of the VR resulting from the fractionation section D | | |
|---|---|---|
| Fraction | | Unconverted vacuum residue |
| Yield with respect to the fresh feedstock (A) | % by weight | 10.8 |
| Content of 540° C.+ | % by weight | 100 |
| Density | g/cm$^3$ | 0.9952 |
| Conradson carbon | % by weight | 17.05 |
| Nickel + Vanadium | ppm | 19.4 |
| Nitrogen | ppm | 7350 |
| Sulfur | % by weight | 0.582 |
| Saturates | % by weight | 18.5 |
| Aromatics | % by weight | 41.4 |
| Resins | % by weight | 35.4 |
| $C_7$ Asphaltenes | % by weight | 4.8 |

Deasphalting Section (E)

The vacuum residue resulting from section D is sent into the deasphalting section E. The conditions applied in the deasphalting unit described in table 21.

TABLE 21

| Operating conditions in the SDA unit E | | |
|---|---|---|
| Feedstock | | Vacuum residue resulting from section D |
| Solvent | | butane |
| Extractor pressure | MPa | 3.0 |
| $T_{mean}$ extractor | ° C. | 95 |
| Solvent/feedstock ratio | v/v | 8 |

On conclusion of section E, a DAO fraction, which can be economically enhanced in a conversion process (hydrocracking, FCC or recycling to the hydroconversion process), and an "asphalt" fraction, which is difficult to economically enhance, are obtained. The yields and qualities of these two products are given in table 22.

TABLE 22

| Yields and qualities of the effluents resulting from the deasphalting section E | | | |
|---|---|---|---|
| Fraction | | DAO | Asphalt |
| Yield with respect to the unconverted VR | % by weight | 66.8 | 33.2 |
| Yield with respect to the fresh feedstock (A) | % by weight | 7.2 | 3.6 |
| Density | g/cm$^3$ | 0.9505 | 1.0995 |
| Conradson carbon | % by weight | 8.3 | 34.6 |
| $C_7$ Asphaltenes | % by weight | 0.07 | 14.2 |
| Nickel + Vanadium | ppm | <2 | 57.9 |
| Nitrogen | ppm | 4670 | 12 750 |
| Sulfur | % by weight | 0.515 | 0.716 |

Overall Performance Qualities

With this scheme according to the invention having an overall HSV=0.089 h$^{-1}$ and having a moderate temperature (420/420° C.), the conversion of the heavy 540° C.+ cut is 86.1% by weight before the deasphalting stage, i.e. greater by 26.9% by weight with respect to example 3 at the same temperature level. The amount of unconverted VR recovered in example 4 is thus approximately 3 times lower. Moreover, the unconverted VR of example 4 contains lower contents of Conradson carbon and $C_7$ asphaltenes in comparison with example 3, which makes it possible to recover a greater amount of DAO from the unconverted VR (66.8% by weight recoverable in this example, versus 54.1% by weight in example 3). Thus, this scheme according to the invention is accompanied by a lower generation of asphalt corresponding to only 3.6% by weight, with respect to the fresh starting feedstock. If all of the DAO is converted in a hydrocracking unit, a very high conversion of the starting heavy 540° C.+ cut of 95.4% by weight can thus be obtained by virtue of this scheme according to the invention.

Example 5 not in Accordance with the Invention

Scheme having a high hourly space velocity and high temperature (overall HSV=0.3 h$^{-1}$+431/431° C.)+deasphalting stage (SDA)+stage of conversion of the DAO in FCC In this example, two ebullating-bed reactors (first and second deep hydroconversion section) are positioned in series, operated at high hourly space velocity (HSV) and high temperature with an inter-step separation section and a downstream deasphalting process. The DAO cut is subsequently converted in an FCC unit.

Hydroconversion Section (A)

The fresh feedstock of table 1 is sent in its entirety into the first ebullating-bed hydroconversion section A, in the presence of hydrogen, which section comprises a three-phase reactor a NiMo/alumina hydroconversion catalyst exhibiting a NiO content of 4% by weight and a $MoO_3$ content of 9% by weight, the percentages being expressed with respect to the total weight of the catalyst. The section operates as an ebullating bed having upflow of liquid and of gas. The conditions applied in the hydroconversion section A are presented in table 2. These operating conditions make it possible to obtain a liquid effluent having a reduced content of Conradson carbon, of metals and of sulfur.

Separation Section (B)

The liquid effluent resulting from section A is subsequently sent into a separation section B composed of a single gas/liquid separator operating at the pressure and at the temperature of the reactor of the first hydroconversion section A. A "light" fraction and a "heavy" fraction are thus separated. The "light" fraction is predominantly composed of molecules having a boiling point of less than 350° C. and the "heavy" fraction is predominantly composed of hydrocarbon molecules boiling at a temperature of at least 350° C.

Hydroconversion Section (C)

The heavy fraction resulting from the separation section B is sent, alone and in its entirety, into a second hydroconversion section C in the presence of hydrogen. Said section comprises a three-phase reactor containing a NiMo/alumina hydroconversion catalyst exhibiting a NiO content of 4% by weight and a $MoO_3$ content of 9% by weight, the percentages being expressed with respect to the total weight of the catalyst. The section operates as an ebullating bed having upflow of liquid and of gas. The conditions applied in the hydroconversion section C are presented in table 4.

Fractionation Section (D)

The effluent from the hydroconversion section C is sent into a fractionation section D composed of an atmospheric distillation, followed by a vacuum distillation, from which an unconverted vacuum residue (VR) heavy fraction boiling at a temperature of at least 540° C. is recovered, the yields with respect to the fresh feedstock and the quality of which are given in table 5.

Deasphalting Section (E)

The vacuum residue resulting from section D is sent into the deasphalting section E. The conditions applied in the deasphalting unit are described in table 6. On conclusion of section E, a DAO fraction and an "asphalt" fraction, which is difficult to economically enhance, are obtained. The yields and qualities of these two products are given in table 7.

Section for Conversion of the DAO (F)

The DAO fraction resulting from the deasphalting section E is subsequently sent to a fluidized-bed catalytic cracking unit, also known as FCC unit. This conversion unit makes it possible to transform the DAO fraction, which is a 540° C.+ cut, into lighter fractions. This thus makes it possible to increase the overall conversion of the starting feedstock (the vacuum residue (VR) originating from a Urals crude oil, the characteristics of which are presented in table 1). On the other hand, the liquid fraction resulting from the FCC unit still contains a slight unconverted 540° C.+ fraction, the yield of which is 1.1% by weight, with respect to the feedstock of the FCC, as indicated in table 23. Compared with example 1, where all the DAO was converted in a hydrocracking unit, the conversion of the DAO is in this instance not total.

TABLE 23

Yields and qualities of the effluents resulting from the FCC unit F

| Unit | | FCC |
|---|---|---|
| Yield Gasoline ($C_5$-220° C.) | % by weight | 40.9 |
| Yield Gas Oil (220-360° C.) | % by weight | 14.2 |
| Yield Vacuum Distillate (360-540° C.) | % by weight | 14.2 |
| Yield Vacuum Residue (540° C.+) | % by weight | 1.1 |

Overall Performance Qualities

With this scheme not in accordance with the invention, for an overall hourly space velocity (HSV) of 0.3 $h^{-1}$ and high temperatures (431/431° C.), the conversion of the heavy 540° C.+ cut is 75.1% by weight before the deasphalting stage. The unconverted VR contains high contents of Conradson carbon and 07 asphaltenes (respectively 22.2% by weight and 9.4% by weight), implying that only 49.9% by weight of the unconverted VR is recoverable in the form of DAO. Thus, this conventional scheme is accompanied by a significant generation of asphalt of 9.7% by weight, with respect to the fresh starting feedstock. The DAO cut is in this instance converted in an FCC unit. With this sequential scheme not in accordance with the invention, for an overall hourly space velocity (HSV) of 0.30 $h^{-1}$ and high temperatures (431/431° C.), the overall conversion of the heavy 540° C.+ cut in the complete scheme is 86.8% by weight.

Example 6 According to the Invention

Scheme according to the invention having a low hourly space velocity (overall HSV=0.089 $h^{-1}$+411/411° C.) and having a low temperature+deasphalting stage (SDA)+stage of conversion of the DAO in FCC In this example, the present invention is illustrated in a process scheme with two ebullating-bed reactors positioned in series, operated at low hourly space velocity (HSV=0.089 $h^{-1}$) and at low temperature (411/411° C.) and with an inter-step separation section and a downstream deasphalting process, as described in connection with FIG. 1. The DAO cut is subsequently converted in an FCC unit.

Hydroconversion Section (A)

The fresh feedstock of table 1 is sent in its entirety into the first ebullating-bed hydroconversion section A, in the presence of hydrogen, which section comprises a three-phase reactor containing a NiMo/alumina hydroconversion catalyst exhibiting a NiO content of 4% by weight and a $MoO_3$ content of 9% by weight, the percentages being expressed with respect to the total weight of the catalyst. The section operates as an ebullating bed having upflow of liquid and of gas. The conditions applied in the hydroconversion section A are presented in table 8.

Separation Section (B)

The liquid effluent resulting from section A is subsequently sent into a separation section B composed of a single gas/liquid separator operating at the pressure and at the temperature of the reactors of the first hydroconversion section A. A "light" fraction and a "heavy" fraction are thus separated. The "light" fraction is predominantly composed of molecules having a boiling point of less than 350° C. and the "heavy" fraction is predominantly composed of hydrocarbon molecules boiling at a temperature of at least 350° C.

Hydroconversion Section (C)

The heavy fraction resulting from the separation section B is sent, alone and in its entirety, into a second ebullating-bed hydroconversion section C, in the presence of hydrogen. Said section comprises a three-phase reactor containing a NiMo/alumina hydroconversion catalyst exhibiting a NiO content of 4% by weight and a $MoO_3$ content of 9% by weight, the percentages being expressed with respect to the total weight of the catalyst. The section operates as an ebullating bed having upflow of liquid and of gas. These operating conditions make it possible to obtain a liquid effluent having a reduced content of Conradson carbon, of metals and of sulfur. The conditions applied in the hydroconversion section C are presented in table 9.

Fractionation Section (D)

The effluent from the hydroconversion section C is sent into a fractionation section D composed of an atmospheric distillation, followed by a vacuum distillation, from which an unconverted vacuum residue (VR) heavy fraction boiling at a temperature of at least 540° C. is recovered, the yields with respect to the fresh feedstock and the quality of which are given in table 10.

Deasphalting Section (E)

The vacuum residue resulting from section D is sent into the deasphalting section E. The conditions applied in the deasphalting unit described in table 11. On conclusion of section E, a DAO fraction and an "asphalt" fraction, which is difficult to economically enhance, are obtained. The yields and qualities of these two products are given in table 12.

Section for Conversion of the DAO (F)

The DAO fraction resulting from the deasphalting section E is subsequently sent to a fluidized-bed catalytic cracking unit, also known as FCC unit. This conversion unit makes it possible to transform the DAO fraction, which is a 540° C.+ cut, into lighter fractions. This thus makes it possible to increase the overall conversion of the starting feedstock (the vacuum residue (VR) originating from a Urals crude oil, the characteristics of which are presented in table 1). On the other hand, the liquid fraction resulting from the FCC unit still contains a slight unconverted 540° C.+ fraction, the yield of which is 1.2% by weight, with respect to the feedstock of the FCC, as indicated in table 24. Compared with example 2, where all the DAO was converted in a hydrocracking unit, the conversion of the DAO is in this instance not total.

TABLE 24

Yields and qualities of the effluents resulting from the FCC unit F

| Unit | | FCC |
|---|---|---|
| Yield Gasoline ($C_5$-220° C.) | % by weight | 41.6 |
| Yield Gas Oil (220-360° C.) | % by weight | 14.3 |
| Yield Vacuum Distillate (360-540° C.) | % by weight | 15.2 |
| Yield Vacuum Residue (540° C.+) | % by weight | 1.2 |

Overall Performance Qualities

With this scheme according to the invention having an overall HSV=0.089 $h^{-1}$, the conversion of the heavy 540° C.+ cut is 75.2% by weight before the deasphalting stage, i.e. comparable to example 5. However, the unconverted VR contains lower contents of Conradson carbon and $C_7$ asphaltenes in comparison with example 5, which makes it possible to recover a greater amount of DAO from the unconverted VR (68.2% by weight recoverable in this example, versus 49.9% by weight in example 5). Thus, this scheme according to the invention is accompanied by a lower generation of asphalt corresponding to 6.1% by weight, with respect to the fresh starting feedstock. The DAO cut is in this instance converted in an FCC unit. With this sequential scheme according to the invention, for an overall hourly space velocity (HSV) of 0.089 $h^{-1}$ and low temperatures (411/411° C.), the overall conversion of the heavy 540° C.+ cut in the complete scheme is 91.0% by weight, with respect to the starting heavy 540° C.+ cut, i.e. 4.2 conversion points more than in example 5. The scheme according to the invention thus makes it possible to exceed a conversion of 90% by weight, with respect to the fresh feedstock.

Example 7 not in Accordance with the Invention

Scheme having a high hourly space velocity and having a moderate temperature (overall HSV=0.3 $h^{-1}$+420/420° C.)+ deasphalting stage (SDA)+stage of conversion of the DAO in FCC In this example, the operation is carried out with two ebullating-bed reactors positioned in series (first and second deep hydroconversions), which are operated at high hourly space velocity (HSV) and at moderate temperature (420° C.) with an inter-step separation section and a downstream deasphalting process. The DAO cut is subsequently converted in an FCC unit.

Hydroconversion Section (A)

The fresh feedstock of table 1 is sent, in its entirety, into an ebullating-bed hydroconversion section A, in the presence of hydrogen. The three-phase reactor contains a NiMo/alumina hydroconversion catalyst exhibiting a NiO content of 4% by weight and a $MoO_3$ content of 9% by weight, the percentages being expressed with respect to the total weight of the catalyst. The section operates as an ebullating bed having upflow of liquid and of gas.

The conditions applied in the hydroconversion section A are presented in table 13. These operating conditions make it possible to obtain a liquid effluent having a reduced content of Conradson carbon, of metals and of sulfur.

Separation Section (B)

The liquid effluent resulting from section A is subsequently sent into a separation section B composed of a single gas/liquid separator operating at the pressure and at the temperature of the reactors of the first hydroconversion section A. A "light" fraction and a "heavy" fraction are thus separated. The "light" fraction is predominantly composed of molecules having a boiling point of less than 350° C. and the "heavy" fraction is predominantly composed of hydrocarbon molecules boiling at a temperature of at least 350° C.

Hydroconversion Section (C)

The heavy fraction resulting from the separation section B is sent, alone and in its entirety, into a second ebullating-bed hydroconversion section C, in the presence of hydrogen. Said section comprises a three-phase reactor containing a NiMo/alumina hydroconversion catalyst exhibiting a NiO content of 4% by weight and a $MoO_3$ content of 9% by weight, the percentages being expressed with respect to the total weight of the catalyst. The section operates as an ebullating bed having upflow of liquid and of gas. The conditions applied in the hydroconversion section C are presented in table 14.

Fractionation Section (D)

The effluent from the hydroconversion section C is sent into a fractionation section D composed of an atmospheric distillation, followed by a vacuum distillation, from which an unconverted vacuum residue (VR) heavy fraction boiling at a temperature of at least 540° C. is recovered, the yields with respect to the fresh feedstock and the quality of which are given in table 15.

Deasphalting Section (E)

The vacuum residue resulting from section D is sent into the deasphalting section E. The conditions applied in the deasphalting unit described in table 16. On conclusion of section E, a DAO fraction and an "asphalt" fraction, which is difficult to economically enhance, are obtained. The yields and qualities of these two products are given in table 17.

Section for Conversion of the DAO (F)

The DAO fraction resulting from the deasphalting section E is subsequently sent to a fluidized-bed catalytic cracking unit, also known as FCC unit. This conversion unit makes it possible to transform the DAO fraction, which is a 540° C.+ cut, into lighter fractions. This thus makes it possible to increase the overall conversion of the starting feedstock (the vacuum residue (VR) originating from a Urals crude oil, the characteristics of which are presented in table 1). On the other hand, the liquid fraction resulting from the FCC unit still contains a slight unconverted 540° C.+ fraction, the yield of which is 1.9% by weight, with respect to the feedstock of the FCC, as indicated in table 25. Compared with example 3, where all the DAO was converted in a hydrocracking unit, the conversion of the DAO is in this instance not total.

TABLE 25

Yields and qualities of the effluents resulting from the FCC unit F

| Unit | | FCC |
|---|---|---|
| Yield Gasoline ($C_5$-220° C.) | % by weight | 30.9 |
| Yield Gas Oil (220-360° C.) | % by weight | 16.7 |
| Yield Vacuum Distillate (360-540° C.) | % by weight | 22.5 |
| Yield Vacuum Residue (540° C.+) | % by weight | 1.9 |

Overall Performance Qualities

With this scheme, for an overall hourly space velocity (HSV) of 0.3 $h^{-1}$ and moderate temperatures (420/420° C.), the conversion of the heavy 540° C.+ cut is 59.2% by weight before the deasphalting stage. Furthermore, the unconverted VR contains high contents of Conradson carbon and 07 asphaltenes (respectively 20.7% by weight and 8.2% by weight), implying that only 54.1% by weight of the unconverted VR is recoverable in the form of DAO. Thus, this conventional scheme is accompanied by a significant generation of asphalt of 14.6% by weight, with respect to the fresh starting feedstock. The DAO cut is in this instance converted in an FCC unit. With this sequential scheme not in accordance with the invention, for an overall hourly space velocity (HSV) of 0.30 $h^{-1}$ and moderate temperatures (420/420° C.), the overall conversion of the heavy 540° C.+ cut in the complete scheme is 80.0% by weight. This sequence according to the prior art thus does not make it possible to achieve levels of conversion of the heavy 540° C.+ cut of greater than 90% by weight.

Example 8 According to the Invention

Scheme according to the invention having a low hourly space velocity (overall HSV=0.089 $h^{-1}$+420/420° C.) and having a low temperature+deasphalting stage (SDA)+stage of conversion of the DAO in FCC In this example, the present invention is illustrated in a process scheme with two ebullating-bed reactors positioned in series, operated at low hourly space velocity (HSV=0.089 $h^{-1}$) and at moderate temperature (420/420° C.) and with an inter-step separation section and a downstream deasphalting process, according to the scheme of FIG. 1. The DAO cut is subsequently converted in an FCC unit.

Hydroconversion Section (A)

The fresh feedstock of table 1 is sent, in its entirety, into an ebullating-bed hydroconversion section A, in the presence of hydrogen. Said section comprises a three-phase reactor containing a NiMo/alumina hydroconversion catalyst exhibiting a NiO content of 4% by weight and a $MoO_3$ content of 9% by weight, the percentages being expressed with respect to the total weight of the catalyst. The section operates as an ebullating bed having upflow of liquid and of gas. The conditions applied in the hydroconversion section (A) are presented in table 18. These operating conditions make it possible to obtain a liquid effluent having a reduced content of Conradson carbon, of metals and of sulfur.

Separation Section (B)

The liquid effluent resulting from section A is subsequently sent into a separation section B composed of a single gas/liquid separator operating at the pressure and at the temperature of the reactors of the first hydroconversion section A. A "light" fraction and a "heavy" fraction are thus separated. The "light" fraction is predominantly composed of molecules having a boiling point of less than 350° C. and the "heavy" fraction is composed of hydrocarbon molecules boiling at a temperature of at least 350° C.

Hydroconversion Section (C)

In this reference scheme, the heavy fraction resulting from the separation section B is sent, alone and in its entirety, into a second ebullating-bed hydroconversion section C, in the presence of hydrogen. Said section comprises a three-phase reactor containing a NiMo/alumina hydroconversion catalyst exhibiting a NiO content of 4% by weight and a $MoO_3$ content of 9% by weight, the percentages being expressed with respect to the total weight of the catalyst. The section operates as an ebullating bed having upflow of liquid and of gas. The conditions applied in the hydroconversion section C are presented in table 19.

Fractionation Section (D)

The effluent from the hydroconversion section C is sent into a fractionation section D composed of an atmospheric distillation, followed by a vacuum distillation, from which an unconverted vacuum residue (VR) heavy fraction boiling at a temperature of at least 540° C. is recovered, the yields with respect to the fresh feedstock and the quality of which are given in table 20.

Deasphalting Section (E)

The vacuum residue resulting from section D is sent into the deasphalting section E. The conditions applied in the deasphalting unit described in table 21. On conclusion of section E, a DAO fraction, which can be economically enhanced in a conversion process (hydrocracking, FCC or recycling to the hydroconversion process), and an "asphalt" fraction, which is difficult to economically enhance, are obtained. The yields and qualities of these two products are given in table 22.

Section for Conversion of the DAO (F)

The DAO fraction resulting from the deasphalting section E is subsequently sent to a fluidized-bed catalytic cracking unit, also known as FCC unit. This conversion unit makes it possible to transform the DAO fraction, which is a 540° C.+ cut, into lighter fractions. This thus makes it possible to increase the overall conversion of the starting feedstock (the vacuum residue (VR) originating from a Urals crude oil, the characteristics of which are presented in table 1). On the other hand, the liquid fraction resulting from the FCC unit still contains a slight unconverted 540° C.+ fraction, the yield of which is 1.2% by weight, with respect to the feedstock of the FCC, as indicated in table 26. Compared with example 4, where all the DAO was converted in a hydrocracking unit, the conversion of the DAO is in this instance not total.

TABLE 26

Yields and qualities of the effluents resulting from the FCC unit F

| Unit | | FCC |
|---|---|---|
| Yield Gasoline ($C_5$-220° C.) | % by weight | 42.0 |
| Yield Gas Oil (220-360° C.) | % by weight | 14.2 |
| Yield Vacuum Distillate (360-540° C.) | % by weight | 13.8 |
| Yield Vacuum Residue (540° C.+) | % by weight | 1.2 |

Overall Performance Qualities

With this scheme according to the invention having an overall HSV=0.089 $h^{-1}$ and having a moderate temperature (420/420° C.), the conversion of the heavy 540° C.+ cut is 86.1% by weight before the deasphalting stage, i.e. greater by 26.9% by weight with respect to example 7 at the same temperature level. The amount of unconverted VR recovered in example 4 is thus approximately 3 times lower. Moreover, the unconverted VR of example 8 contains lower contents of Conradson carbon and 07 asphaltenes in comparison with example 7, which makes it possible to recover a greater amount of DAO from the unconverted VR (66.8% by weight recoverable in this example, versus 54.1% by weight in example 7). Thus, this scheme according to the invention is accompanied by a lower generation of asphalt corresponding to only 3.6% by weight, with respect to the fresh starting feedstock. The DAO cut is in this instance converted in an FCC unit. With this sequential scheme according to the invention, for an overall hourly space velocity (HSV) of 0.089 $h^{-1}$ and moderate temperatures (420/420° C.), the overall conversion of the heavy 540° C.+ cut in the complete scheme is 94.4% by weight, with respect to the starting heavy 540° C.+ cut, i.e. 14.4 conversion points more than in example 7. The scheme according to the invention thus makes it possible to exceed a conversion of 90% by weight, with respect to the fresh feedstock.

Other solvents, such as pentane ($C_5$), can be used in the deasphalting process instead of the butane ($C_4$) as described here in these 8 examples. The deasphalting with $C_5$ makes it possible to increase the DAO yields and to enhance the advantages of the invention.

The invention claimed is:

1. A process for the conversion of hydrocarbon feedstocks, at least 50% by weight of which boils at a temperature of at least 300° C., comprising the following successive stages:

stage a), a first deep hydroconversion of said hydrocarbon feedstock in the presence of hydrogen, under an absolute pressure of between 2 MPa and 35 MPa, at a temperature of between 300° C. and 550° C., with an amount of hydrogen of between 50 $Sm^3/m^3$ and 5000 $Sm^3/m^3$, with a catalyst containing at least one nickel or cobalt Group VIII metal and at least one molybdenum or tungsten Group VIb metal, stage b) separation of a light fraction from a part or all of effluent resulting from said first deep hydroconversion, and obtaining at least one heavy fraction, at least 80% by weight of which exhibits a boiling point of at least 250° C., by one or more flash drums in series, or by one or more steam stripping and/or hydrogen stripping columns, or by an atmospheric distillation column, alone or followed by a vacuum distillation column, or by a combination thereof, stage c), a second deep hydroconversion of a part or all of the heavy fraction resulting from stage b) in the presence of hydrogen, under an absolute pressure of between 2 MPa and 35 MPa, at a temperature of between 300° C. and 550° C., with an amount of hydrogen of between 50 $Sm^3/m^3$ and 5000 $Sm^3/m^3$, with a catalyst containing at least one nickel or cobalt Group VIII metal and at least one molybdenum or tungsten Group VIb metal, the overall hourly space velocity for stages a) to c) being 0.05-0.09 $h^{-1}$, the overall velocity being the flow rate of liquid feedstock of the hydroconversion stage a), taken under standard temperature and pressure conditions, with respect to the total volume of the reactors of stages a) and c), stage d) separation of a part or all of effluent resulting from said second hydroconversion into at least one light fraction and at least one heavy fraction, at least 80% by weight of which exhibits a boiling point of at least 300° C., stage e) deasphalting said heavy fraction resulting from stage d), at a temperature of between 60° C. and 250° C., with at least one hydrocarbon solvent having from 3 to 7 carbon atoms, and a solvent/feedstock ratio (volume/volume) of between 4/1 and 9/1, obtaining a deasphalted fraction DAO and an asphalt stage f) after optionally distilling, and optionally preliminarily hydrotreating, converting all or a part of the optionally distilled, optionally hydrotreated deasphalted fraction DAO, in a conversion stage operating by fluidized-bed catalytic cracking in the presence of a catalyst comprising alumina, silica, silica/alumina, and optionally comprising at least one zeolite.

2. The process as claimed in claim 1, in which the DAO is distilled before the conversion stage f), so as to separate a heavy fraction, at least 80% by weight of which exhibits a boiling point of at least 375° C., and said heavy fraction sent, in part or in its entirety, into the conversion stage f).

3. The process as claimed in claim 1, in which a part or all of the DAO fraction is sent directly into the conversion stage operating by fluidized-bed catalytic cracking.

4. The process as claimed in claim 1, in which a part or all of the deasphalted fraction DAO is subjected to a fluidized-bed catalytic cracking FCC in the presence of a catalyst comprising alumina, silica, silica/alumina, and comprising at least one zeolite.

5. The process as claimed in claim 1, in which at least a part of said deasphalted fraction DAO is recycled to stage a) and/or to stage c).

6. The process as claimed in claim 1, in which, in the separation stage d), the effluent resulting from said second hydroconversion is separated into at least one light fraction and at least one heavy fraction, at least 80% by weight of which exhibits a boiling point of at least 375° C.

7. The process as claimed in claim 1, in which:

stages a) and c) are carried out under an absolute pressure of between 5 MPa and 25 MPa and at a temperature of between 350° C. and 500° C., with an amount of hydrogen of between 100 $Sm^3/m^3$ and 2000 $Sm^3/m^3$, stage e) is carried out with a butane, pentane or hexane solvent, or a mixture thereof.

8. The process as claimed in claim 1, wherein in f) the HSV of DAO in the conversion stage is 0.15 $h^{-1}$ to 2 $h^{-1}$.

* * * * *